US009254406B2

(12) United States Patent
Riley

(10) Patent No.: US 9,254,406 B2
(45) Date of Patent: Feb. 9, 2016

(54) EXERCISE DEVICE AND ASSOCIATED METHODS

(71) Applicant: Midvale Direct LLC, St. Petersburgh, FL (US)

(72) Inventor: Forbes Riley, St. Petersburg, FL (US)

(73) Assignee: Midvale Direct LLC, Petersburgh, FL (US)

( * ) Notice: Subject to any disclaimer, the term of this patent is extended or adjusted under 35 U.S.C. 154(b) by 0 days.

(21) Appl. No.: 14/793,413

(22) Filed: Jul. 7, 2015

(65) Prior Publication Data

US 2016/0001121 A1 Jan. 7, 2016

Related U.S. Application Data

(63) Continuation-in-part of application No. 14/162,248, filed on Jan. 23, 2014, now Pat. No. 9,072,934, which is a continuation of application No. 12/970,655, filed on Dec. 16, 2010, now Pat. No. 8,668,631.

(60) Provisional application No. 61/287,096, filed on Dec. 16, 2009.

(51) Int. Cl.
*A63B 21/02* (2006.01)
*A63B 21/055* (2006.01)
*A63H 1/32* (2006.01)

(52) U.S. Cl.
CPC ..... *A63B 21/0552* (2013.01); *A63H 1/32* (2013.01)

(58) Field of Classification Search
CPC ..... A63B 21/0552; A63B 21/0023; A63B 21/1469; A63B 21/22; A63B 21/00043; A63H 1/32
See application file for complete search history.

(56) References Cited

U.S. PATENT DOCUMENTS

| | | | | | |
|---|---|---|---|---|---|
| 1,431,604 | A * | 10/1922 | Stemons | A63H 1/32 | 446/214 |
| D165,752 | S * | 1/1952 | Helm | D21/463 | |
| 3,052,060 | A * | 9/1962 | Wohlstrom | A63H 1/32 | 446/22 |
| 3,516,195 | A * | 6/1970 | Batley | A63H 1/32 | 446/254 |
| D219,464 | S * | 12/1970 | Pearce | D21/463 | |
| 4,953,854 | A * | 9/1990 | Pizur, Sr. | A63B 21/227 | 482/110 |
| 5,512,028 | A * | 4/1996 | Sparks, III | A63B 21/0004 | 446/253 |
| 5,674,159 | A * | 10/1997 | Davidson | A63B 21/1663 | 446/253 |
| 6,120,342 | A * | 9/2000 | Chan | A63H 1/32 | 446/247 |
| 6,482,137 | B2 * | 11/2002 | Walker | A63B 21/227 | 446/254 |
| D579,991 | S * | 11/2008 | Arnstein | D21/455 | |
| 2010/0015883 | A1 * | 1/2010 | Boudreaux | A63H 1/32 | 446/253 |

* cited by examiner

*Primary Examiner* — Glenn Richman
(74) *Attorney, Agent, or Firm* — Thorpe North & Western, LLP

(57) ABSTRACT

A method of fatiguing a target muscle group of a user using an exercise device includes grasping in each hand one of a pair of outer handles of an exercise device, positioning the user's feet to be substantially aligned with the user's shoulders while maintaining the user's torso in a substantially upright orientation, positioning each hand in an initial position relative to the user's torso, cyclically pulling the outer handles away from one another in a cyclic motion to apply a cyclic pulling force to the tethers to cause the central disk to alternately rotate in opposing directions of rotation, and moving one or both hands to a secondary position relative to the user's torso and repeating the application of the cyclic force to fatigue the initial target muscle group or to fatigue a secondary target muscle group.

20 Claims, 11 Drawing Sheets

EXERCISE DEVICE AND ASSOCIATED METHODS

PRIORITY CLAIM

This is a continuation-in-part of U.S. patent application Ser. No. 14/162,248, filed Jan. 23, 2014, which is a continuation of U.S. patent application Ser. No. 12/970,655, filed Dec. 16, 2010, which claims benefit and priority to and of U.S. Provisional Patent Application Ser. No. 61/287,096, filed Dec. 16, 2009, each of which is hereby incorporated herein by reference in its entirety.

FIELD OF THE INVENTION

1. Background

The present invention relates generally to exercise and physical therapy regimes. More specifically, the present invention relates to such regimes that utilize hand-held exercise devices that incorporate a disk spinnable about or with one or more cords.

2. Related Art

Numerous personal exercise devices have been developed over the years. Some such devices are very heavy and bulky, and not easily transported from one location to another. Other such devices have been simplified to enable ease of transportation. However, many times such simplification has resulted in diminishing the benefit received by users from utilizing the devices. All such conventional devices have failed to provide a simple, easy-to-use device that is lightweight and portable, and provides an efficacious physical workout for those who use it.

SUMMARY OF THE INVENTION

In accordance with one embodiment, the present invention provides a method of fatiguing one or more target muscle groups of a user using an exercise device. The method can include grasping in each hand one of a pair of outer handles of an exercise device, each of the pair of outer handles being connected to at least one tether, the at least one tether being one or both of a pair of tethers extending through a pair of orifices formed in a central disk suspended between the outer handles. The user's feet can be positioned to be substantially aligned with the user's shoulders while maintaining the user's torso in a substantially upright orientation. The method can include positioning each hand in an initial position relative to the user's torso and rotating one or both of the user's hands grasping the outer handles to cause the central disk to rotate to thereby cause the pair of tethers to twist about one another. The outer handles can be cyclically pulled the outer handles away from one another in a cyclic motion to apply a cyclic pulling force to the tethers to cause the central disk to alternately rotate in opposing directions of rotation, the cyclic motion thereby applying a cyclic force to an initial target muscle group of the user to thereby fatigue the target muscle group. The method can also include moving one or both hands to a secondary position relative to the user's torso and repeating the application of the cyclic force to fatigue the initial target muscle group or to fatigue a secondary target muscle group.

In accordance with another aspect of the invention, a method of fatiguing one or more target muscle groups of a user using an exercise device is provided. This embodiment can include one or more of the aspects provided immediately above, and can also include bending one or more of the user's legs while maintaining the user's spine in a substantially straight orientation.

In accordance with another aspect of the invention, a method of fatiguing one or more target muscle groups of a user using an exercise device is provided. This method can include one or more of the aspects discussed immediately above, and can also include positioning the user's torso in a prone position on a floor or ground surface.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
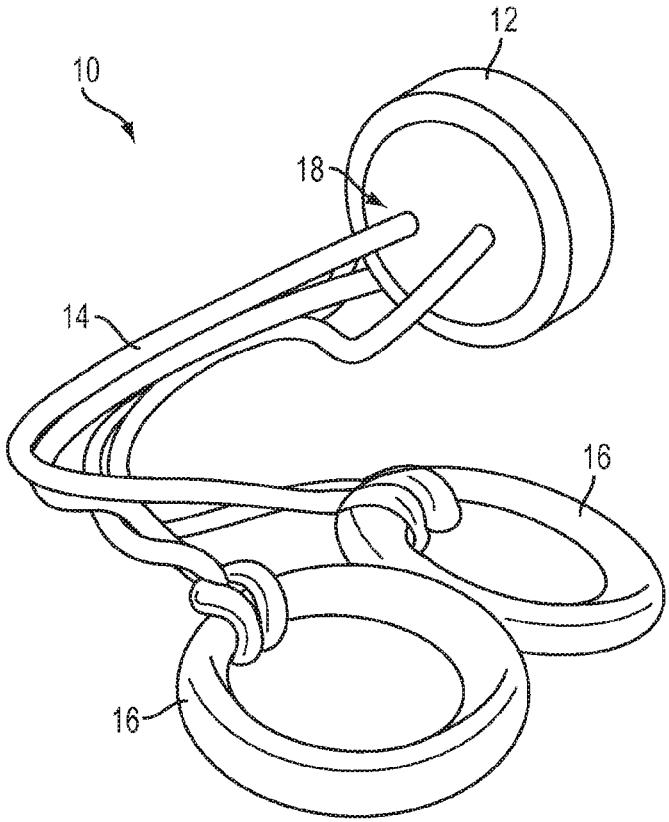
FIG. 1A is a perspective view of an exercise device in accordance with an embodiment of the invention.

It is to be understood that the figures provided herewith are intended to show the invention in the most straightforward manner, and are not necessarily drawn to scale. Also, not all features of the invention are shown in each view; some features of the invention are omitted from various views in order to simplify the presentation of information herein.

DETAILED DESCRIPTION

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" can include plural referents, unless the context clearly dictates otherwise. Thus, for example, reference to a "ring" can include reference to one or more of such rings.

DEFINITIONS

In describing and claiming the present invention, the following terminology will be used in accordance with the definitions set forth below.

Relative directional terms, such as "upper," "lower," "top," bottom," etc., are used herein to aid in describing various features of the present system. It is to be understood that such terms are generally used in a manner consistent with the understanding one of ordinary skill in the art would have of such systems. Such terms should not, however, be construed to limit the present invention.

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

In one particular example, the term "substantially" is used to describe the position of a user's hands, typically while grasping a portion of an exercise device, relative to various portions of the user's torso. When used in this context, the term "substantially" shall be interpreted to refer to a range of deviation of not more than about two or three inches above or below the referenced location.

As used herein, the term "about" is used to provide flexibility to a numerical range endpoint by providing that a given value may be "a little above" or "a little below" the endpoint. In some cases, the term "about" is to include a range of not more than about two inches of deviation.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value and should apply regardless of the breadth of the range or the characteristics being described.

INVENTION

Figure 1B:
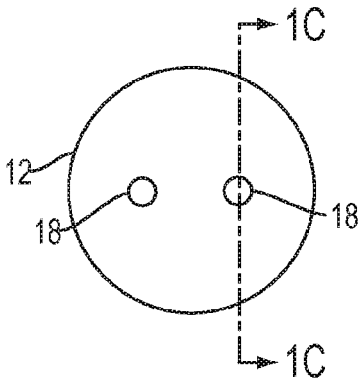
FIG. 1B is a plan view of the disk of the exercise device of FIG. 1A, shown with the rings and cords removed.

The present invention generally provides devices and methods for exercising various muscle groups of the human body. Such methods have also proved advantageous in physical therapy regimes. One exemplary device that can be utilized with the present methods is shown at 10 in FIG. 1A. In this embodiment, the device includes a pair of handles or rings 16, between which extends one or more cords or tethers 14. In the embodiment shown, a single cord is utilized; it is attached to and extends from one ring, is attached to the other ring, and extends back to and is again attached to the initial ring. In this manner, the equivalent of two cords is established between the two rings. A central disk 12 is provided that can include a pair of orifices 18 formed therethrough (see FIG. 1B for a more clear illustration of the central disk and orifices).

In general operation, the rings 16 are manipulated by a user in such a way to cause the cord or cords 14 (sometimes referred to as a pair of cords, even if only one cord is doubled-back on itself to create a pair of side-by-side cords) to twist relative to one another, which in turn results in the central disk 12 spinning rapidly and creating forces on the user's hands (which are grasping the disks). In this manner, a variety of different exercises can be provided by the invention, depending upon the manner in which the rings are grasped, the position relative to the person's various muscle groups in which the rings are held, the force applied to the cord, the fingers used to grasp the rings, etc.

The cord 14 utilized with the present invention can be formed from a variety of materials and in a variety of configurations. Generally, however, the cord is relatively flexible and bendable. Suitable materials for use in the cord include, without limitation, natural or synthetic twine, nylon cording, natural or synthetic string, and the like.

Figure 2:
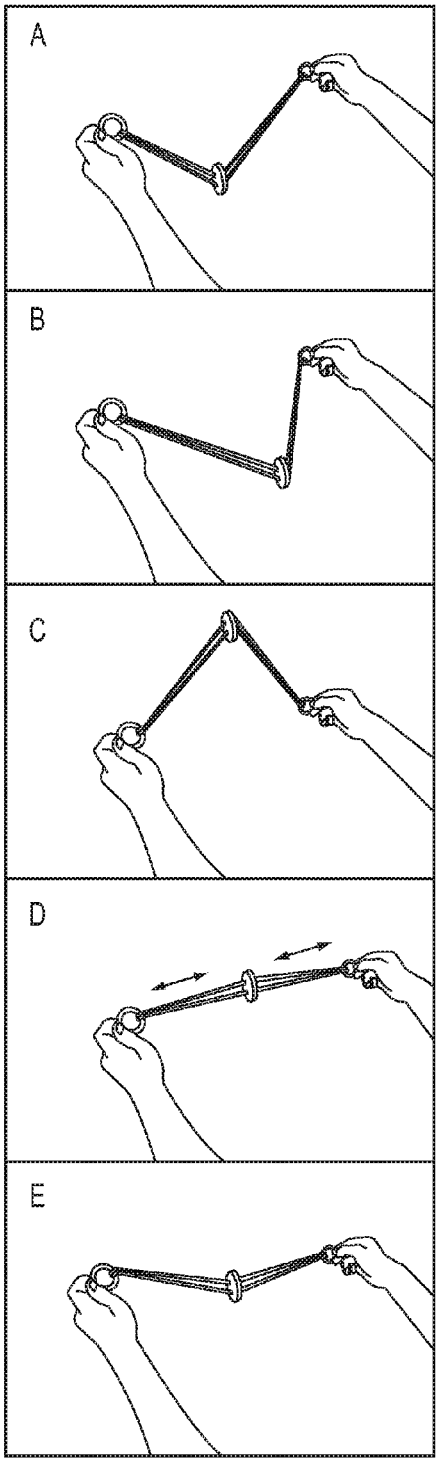
FIG. 2 includes a series of views illustrating basic uses of the exercise device of the present invention.

FIG. 2 includes a series of illustrations that teach basic techniques for manipulating the device 10. The following description can be used to instruct a user of the device in basic use of the device:

FIG. 2A: grasp one of each of the rings of the device in each hand and position the disk approximately midway between the rings;

FIG. 2B: extend arms and hold the rings approximately 6-8 inches apart. Then, spin the disk gently around 20 times to cause the cords to twist about themselves;

FIG. 2C: the cords will gradually appear to become shorter and thicker (as they twist upon themselves), at which point the device has been "wound" for use;

FIG. 2D: pull simultaneously outward on each ring to initiate rotation of the disk. Immediately release pressure, allowing the disk to rewind in the opposite direction (the pressure should be released prior to the point at which the cords or tethers transition between unwinding from one direction and winding in another direction);

FIG. 2E: once the rotation of the disk is felt to diminish, pull smoothly outwardly again, repeating the initial pattern. Repeat this procedure to create a cyclic rhythm that can be maintained for an extended period of time.

By executing the procedures outlined immediately above, the user can cause the central disk to cyclically and alternately rotate in opposing directions: this cyclic motion of the disk (or creation of this cyclic motion) applies stress to various muscle groups of the user, thereby exercising these various muscle groups. This basic technique is used in all of the exercises and physical therapy ("PT") regimes outlined in this disclosure.

The central disk 12 and outer handles can 16 can be formed in a variety of configurations and from a variety of materials. In the embodiments shown, the central disk is substantially a short cylinder formed of a metallic material, such as aluminum, stainless steel, and the like. While a cylinder is shown, it is understood that the central disk can be formed in variety of shapes, include generally square or rectangular shapes, triangular shapes, etc. So long as the shape of the disk results in it being capable of being spun in cyclic, alternately opposing directions, virtually any shape can be utilized.

Similarly, while the handles 16 are shown as being generally toroidal rings, they can be formed in a variety of shapes and configurations that are suitable for grasping by a user of the device.

As described above, the cord or tether 14 can either comprise a single piece of material that is wrapped twice through the disk 12 and connected to the handles 16, or can comprise two separate pieces of material that are each attached to the handles. In either case, the resulting configuration is a pair of tethers or cords, separated by a small gap, that extend through the disk. It is by twisting these tethers or cords about one another that provides a spinning motion to be imparted to the disk as the handles are pulled away from one another (thereby "un-twisting" the tethers and causing the disk to spin).

Repeated application of pulling forces to the handles causes a surprisingly powerful spinning motion of the disk that alternates directions of spin as force is cyclically applied to and released from the handles. This cyclic, alternating force provides a surprisingly good exercise regime for the muscles of the arms, back, abdomen, etc. (depending upon how and where the device is held, as is discussed in further detail below). The muscle groups used in pulling the rings or handles are stressed repeatedly in a cyclic manner: they are stressed as they apply the force to pull the rings or handle away from one another; and they are also stressed as the centrifugal force of the spinning disk tightly coils the pair of cords leading up to and just prior to the point where the direction of rotation of the disk must change (e.g., as the spinning disk coils the cords and thereby pulls the handles toward one another).

Figure 1C:
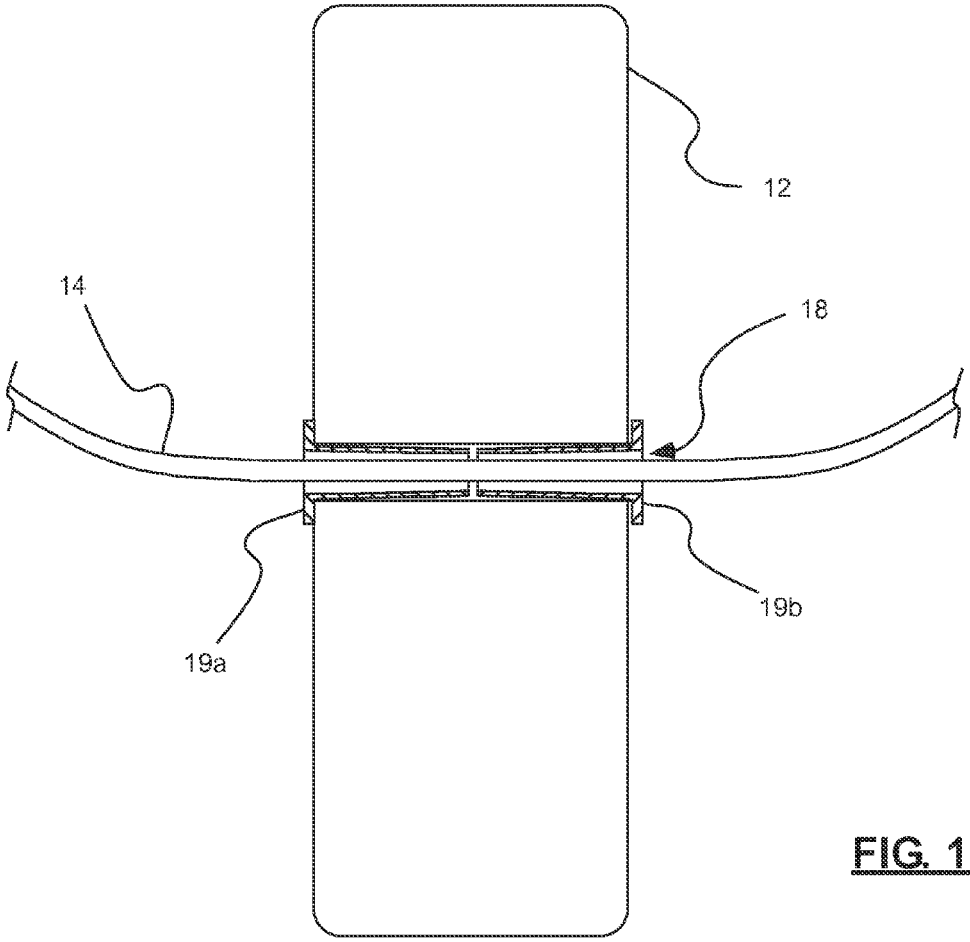
FIG. 1C is a sectioned view of the disk of FIG. 1A, taken along section C-C of FIG. 1B, shown with a cord extending through an orifice of the disk and with a pair of grommets installed within the orifice.

As shown in FIG. 1C, in one aspect of the invention, a grommet or bushing 19*a*, 19*b* can applied to or through the orifices 18 formed in the disk to reduce wear on the tether or cord 14 and to reduce friction between the disk 12 and the tether. The grommet is typically formed from a material that is relatively more soft than the disk material. In the embodiment shown, a pair of grommets 19*a*, 19*b* are utilized, each being inserted into the disk from an opposing side of the disk. In other embodiments, a single piece can be used, and can extend from one side of the disk to another without interruption. Similarly, when two grommets are utilized, they can tightly abut one another within the orifice; or they can overlap slightly to ensure that the entire internal surface of the orifice is covered.

A variety of variations on the basic use of the device can be achieved by varying the manner in which the handles 16 are grasped by the user, and the distance from a user's body the device is held, as well as the location of the device relative to the user's torso, and the user's hand relative to one another. The exercises described herein can be used for general health and fitness, or for PT regimes to help heal various injuries or conditions.

The exercise protocols discussed herein are based more on general pathology rather than specific dysfunctions. The present inventor has determined that medical professionals can tailor these regimes or routines to address specific patient needs. In general, a user is encouraged to utilize these exercises in the subacute or chronic time periods of tissue healing. The patient or user is encouraged to begin with one "set" of cycles to moderate fatigue, then progress to two-three sets to moderate fatigue over a three-week period.

FIGS. 3-10 illustrate some specific examples of exercise or PT regimes in accordance with embodiments of the invention. In the example provided in FIG. 3, a method of fatiguing one or more target muscle groups of a user using the exercise device is provided. In this example, the basic technique described above is used to cycle the exercise device. As shown, the user's arms 20*a*, 20*b* are held in front of the user, with each hand 22*a*, 22*b* grasping one of the aforementioned rings 16. The user's legs 24*a*, 24*b* and feet 26*a*, 26*b* are positioned to be substantially aligned with the user's shoulders 28*a*, 28*b* while maintaining the user's torso (e.g., spine) in a substantially upright orientation.

Figure 3:
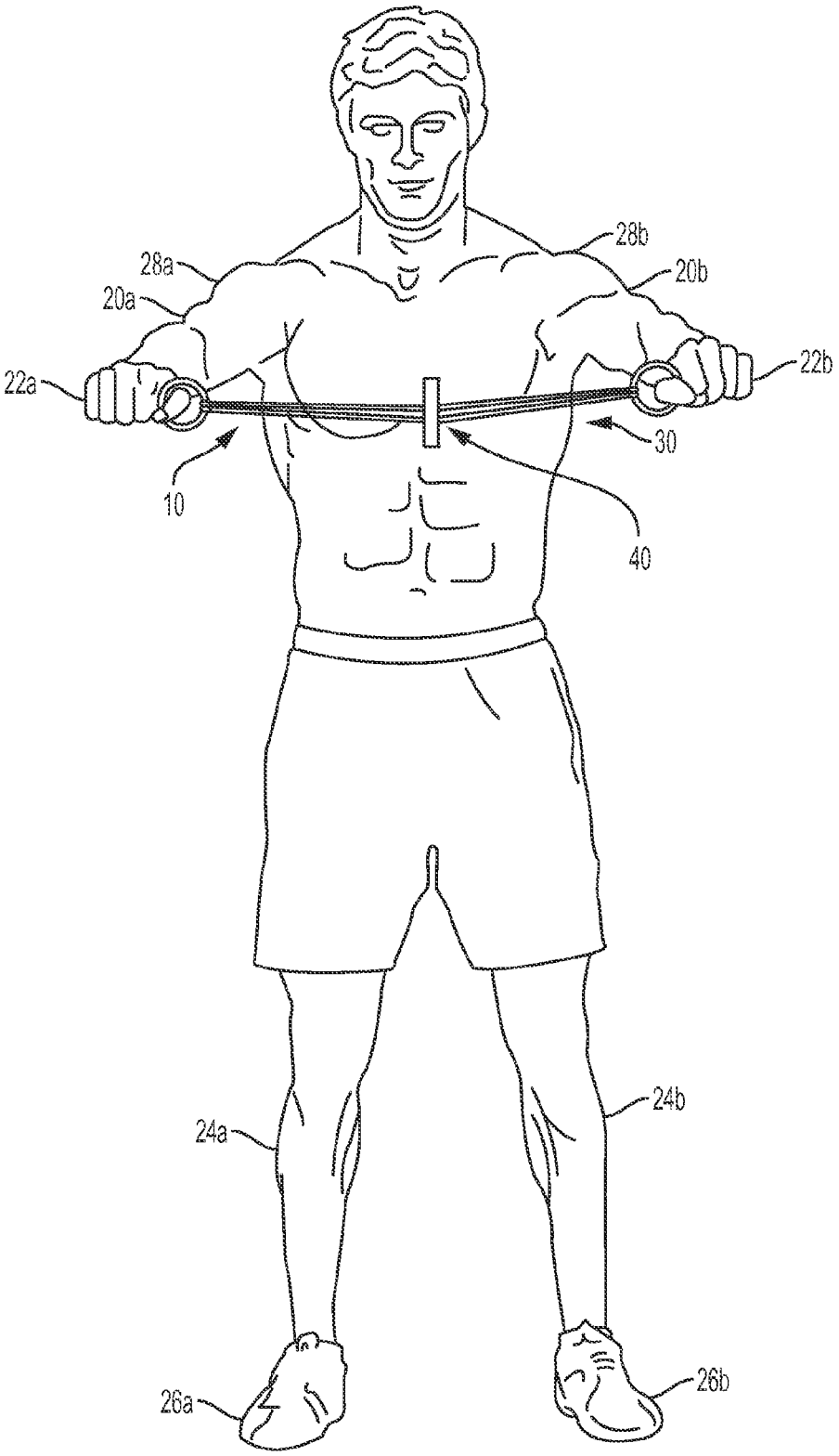
FIG. 3 is a front view of a user utilizing the exercise device of FIG. 1A in accordance with an embodiment of the invention, with the user's hands held at an approximate height of the user's sternum.
Figure 4:
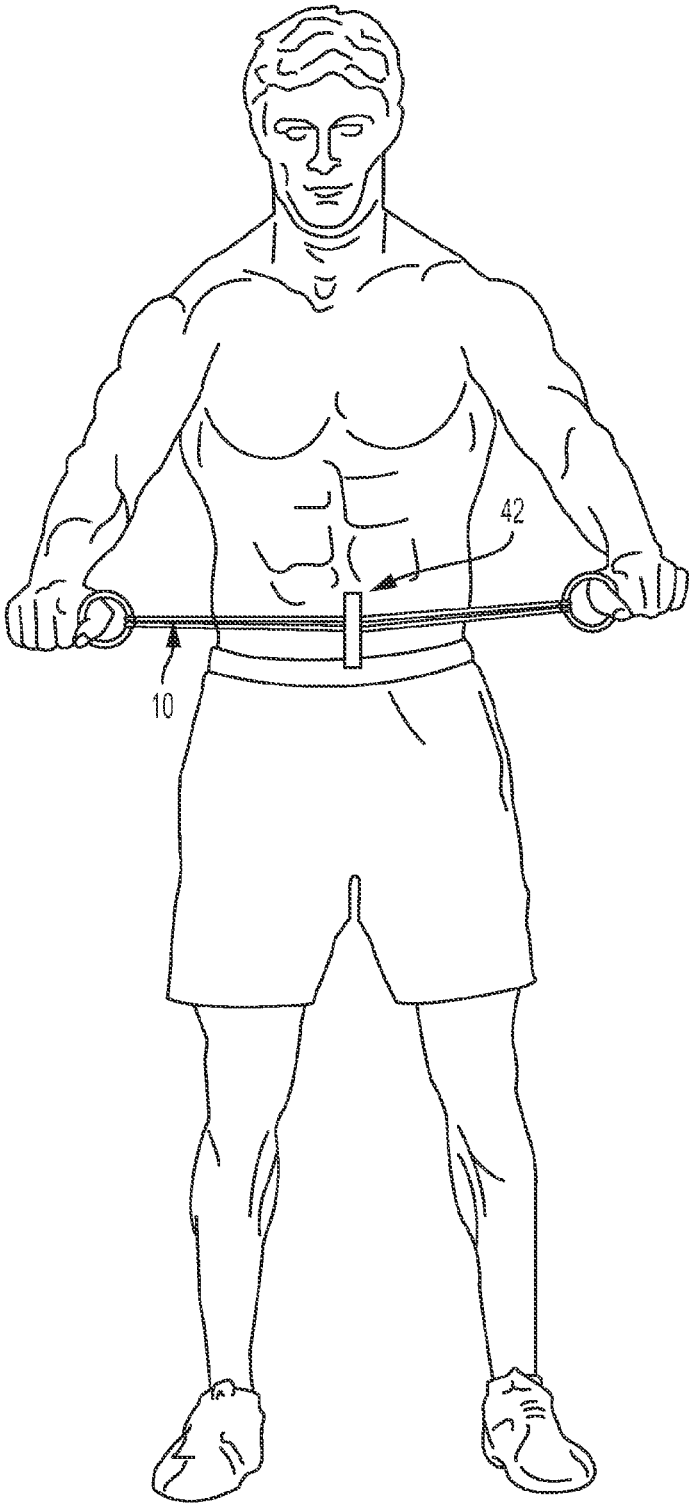
FIG. 4 is a front view of a user utilizing the exercise device of FIG. 1A in accordance with an embodiment of the invention, with the user's hands held at an approximate height of the user's naval.
Figure 5:
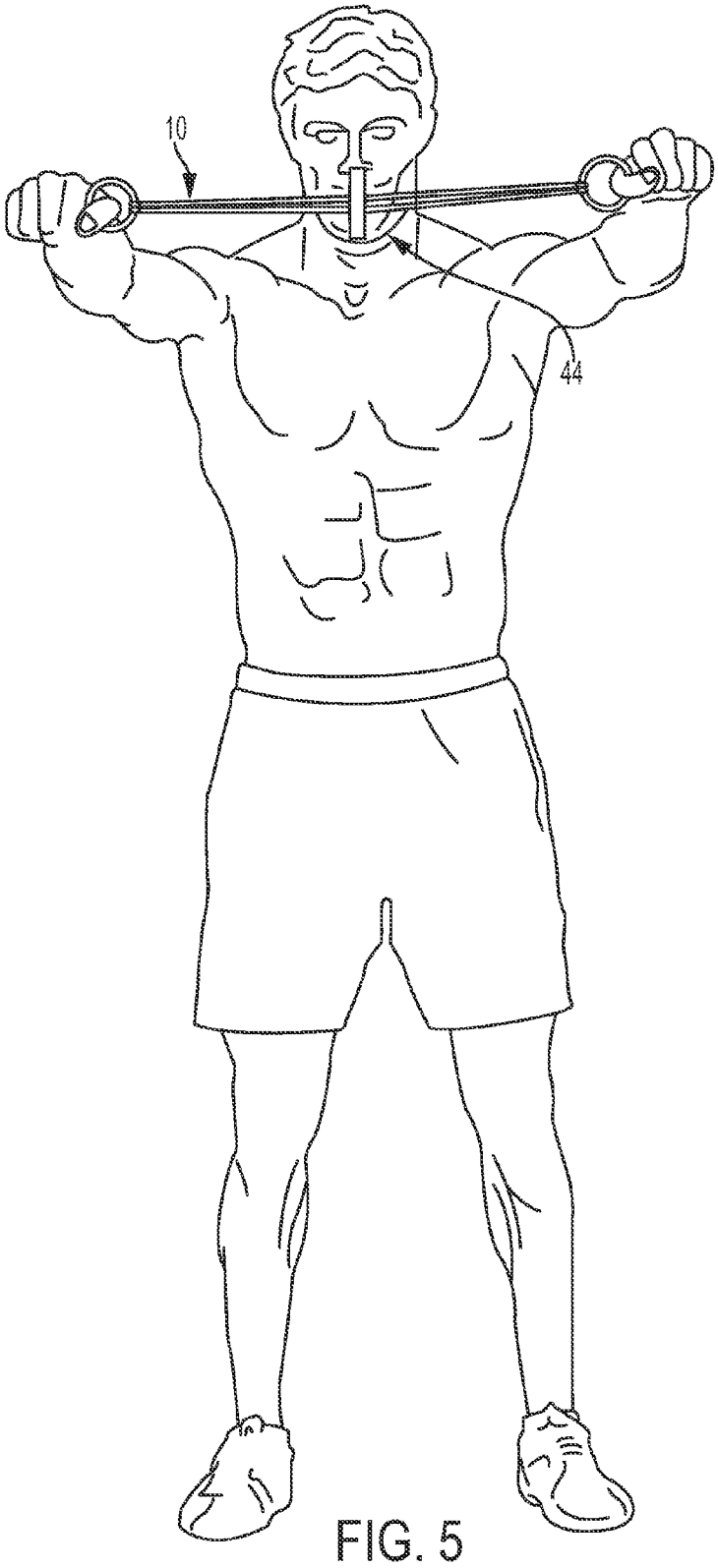
FIG. 5 is a front view of a user utilizing the exercise device of FIG. 1A in accordance with an embodiment of the invention, with the user's hands held at an approximate height of the user's chin.
Figure 6:
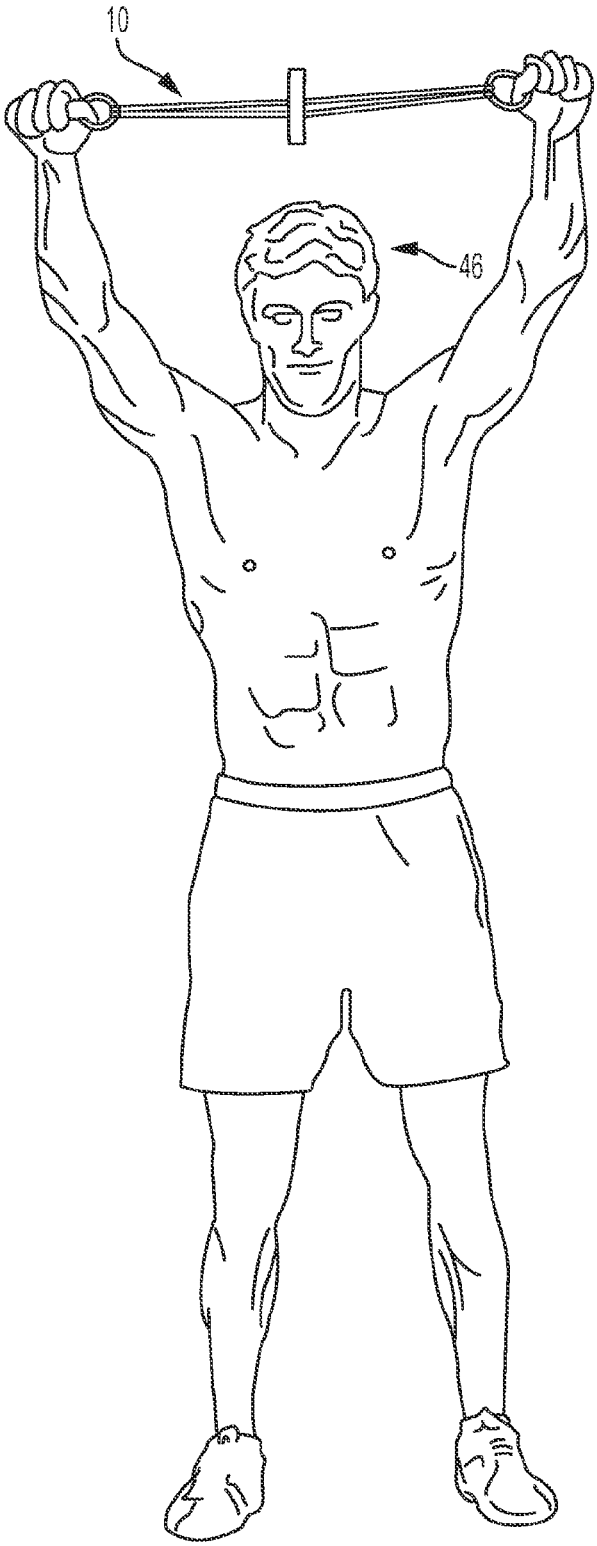
FIG. 6 is a front view of a user utilizing the exercise device of FIG. 1A in accordance with an embodiment of the invention, with the user's hands held over the user's head.

In this example, the user's hands 22*a*, 22*b* are held in a first or initial position while performing the disk cycling described above. After this set of exercises is completed, the user can move one or both hands 22*a*, 22*b* to a secondary position relative to the user's torso, then repeat the disk cycling routine to fatigue either the initial target muscle group or to fatigue a secondary target muscle group. For example, as shown in FIGS. 3-6, the user's hands are placed in the initial position at substantially the same height. In FIG. 3, the user's hands are maintained at a height of about the user's sternum 40. In FIG. 4, the user's hands are maintained at about a height of the user's naval 42. In FIG. 5, the user's hands are maintained at about a height of the user's chin 44. In FIG. 6, the user's hands are maintained at above the user's head 46.

Figure 7:
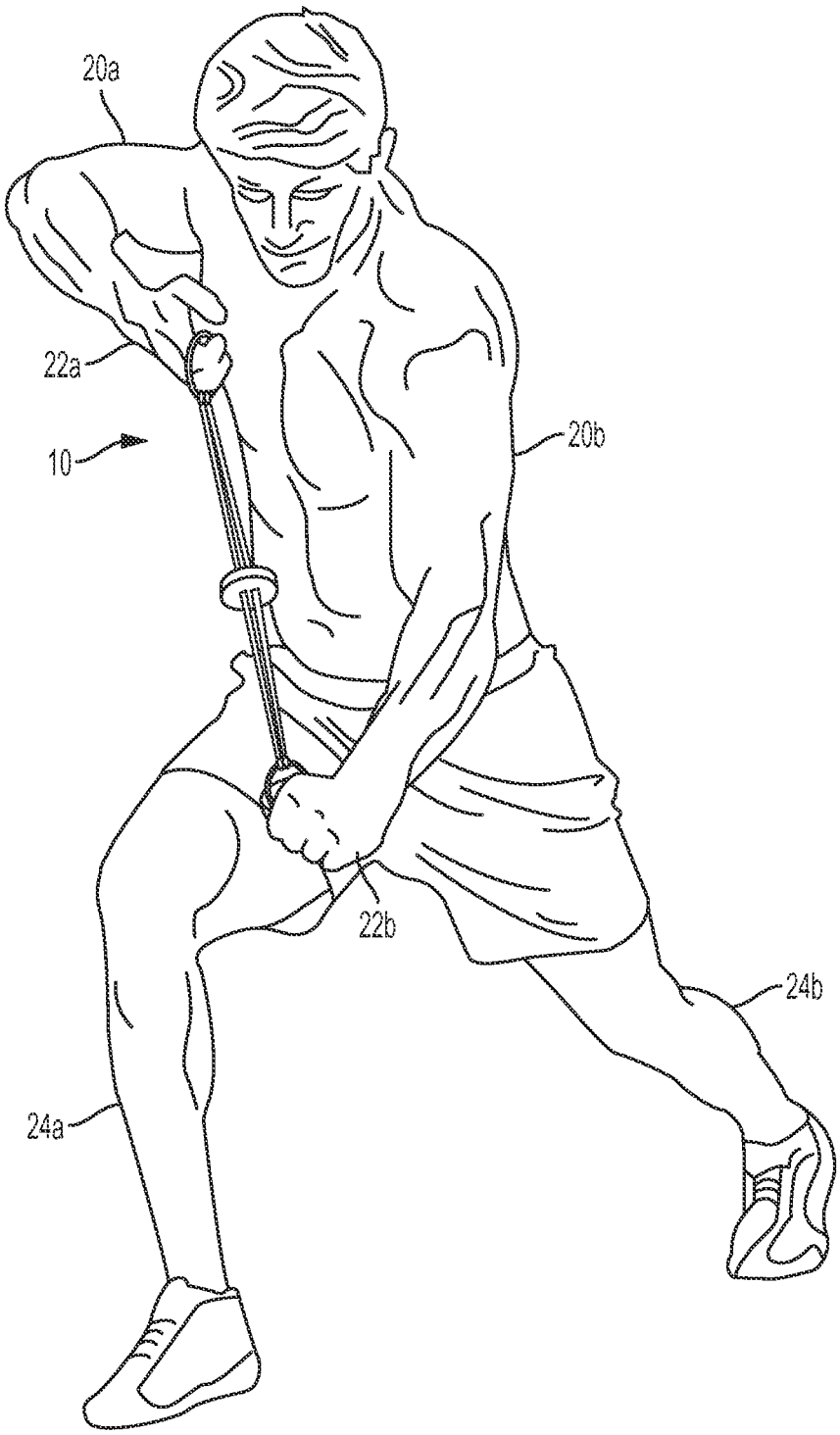
FIG. 7 is a front, side view of a user utilizing the exercise device of FIG. 1A in accordance with an embodiment of the invention, with the user's legs positioned forwardly and rearwardly of the user's torso, and with one hand held at a higher elevation than another hand.

A further variation on the user's body position is illustrated in FIG. 7. In this example, leg 24*a* is positioned forward of the user's torso, in a slightly bent configuration. Leg 24*b* is positioned rearwardly of the user's torso, in a more straight orientation. Arm 20*a* is held in a bent orientation, with arm 20*b* held in a straight orientation (this position is sometimes called a "bow-and-arrow" position). In one variation on this exercise, hand 22*a* (or hand 22*b*) can be maintained in substantially one position, while the other hand is moved to create and maintain the disk cycling. This differs slightly from the typical disk cycling scenario, where both hands are moved slightly to create and maintain the disk cycling.

As will be appreciated, in this example, hand 22*a* is held at a higher elevation than is hand 22*b*. This is but one example of the variety that can be obtained using the present device: the user's legs can be bent or straight, behind or in front of the user; the user's arms can be bent or straight, with the hands held at the same elevation, or at different elevations; the user's hands can be above, in front of, or behind the user's head and torso, etc.

Figure 8:
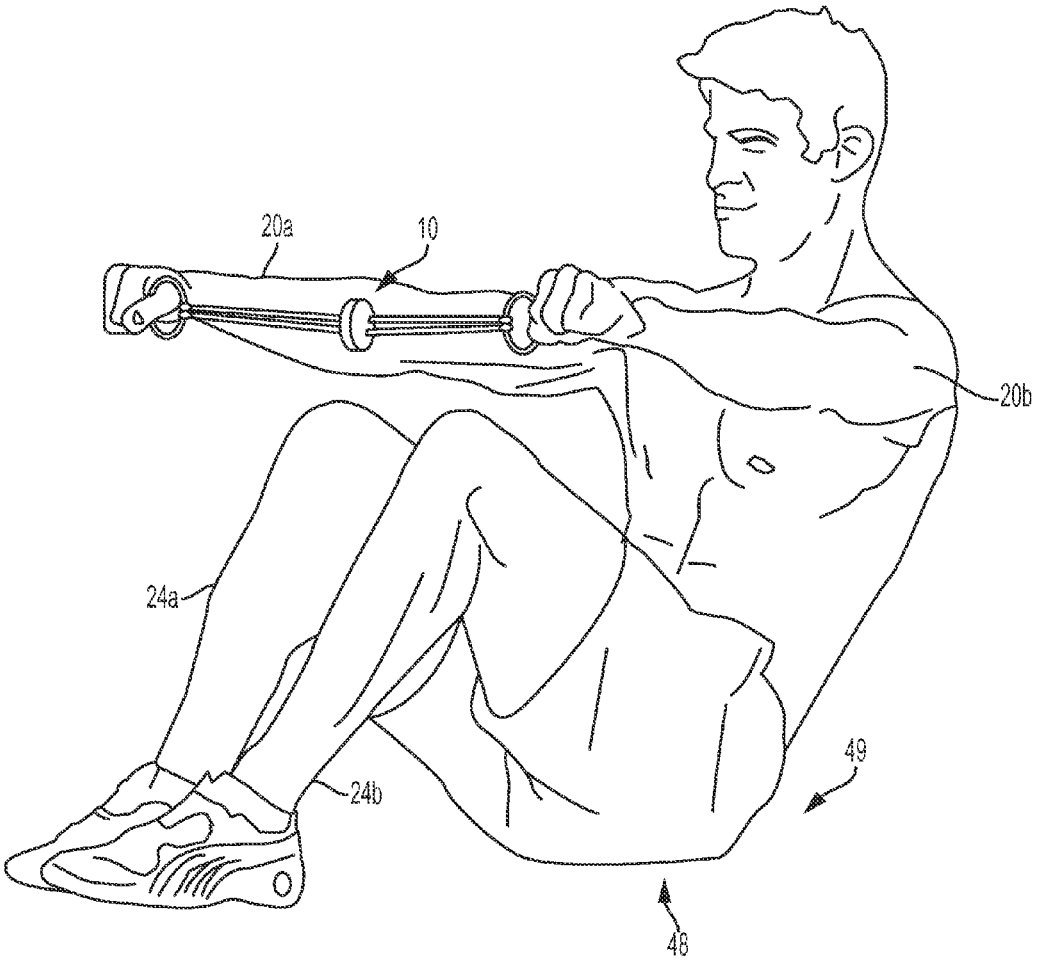
FIG. 8 is a front, side view of a user utilizing the exercise device of FIG. 1A in accordance with an embodiment of the invention, with the user's buttocks positioned on a ground surface, and with his legs positioned forwardly of the user's torso.
Figure 9:
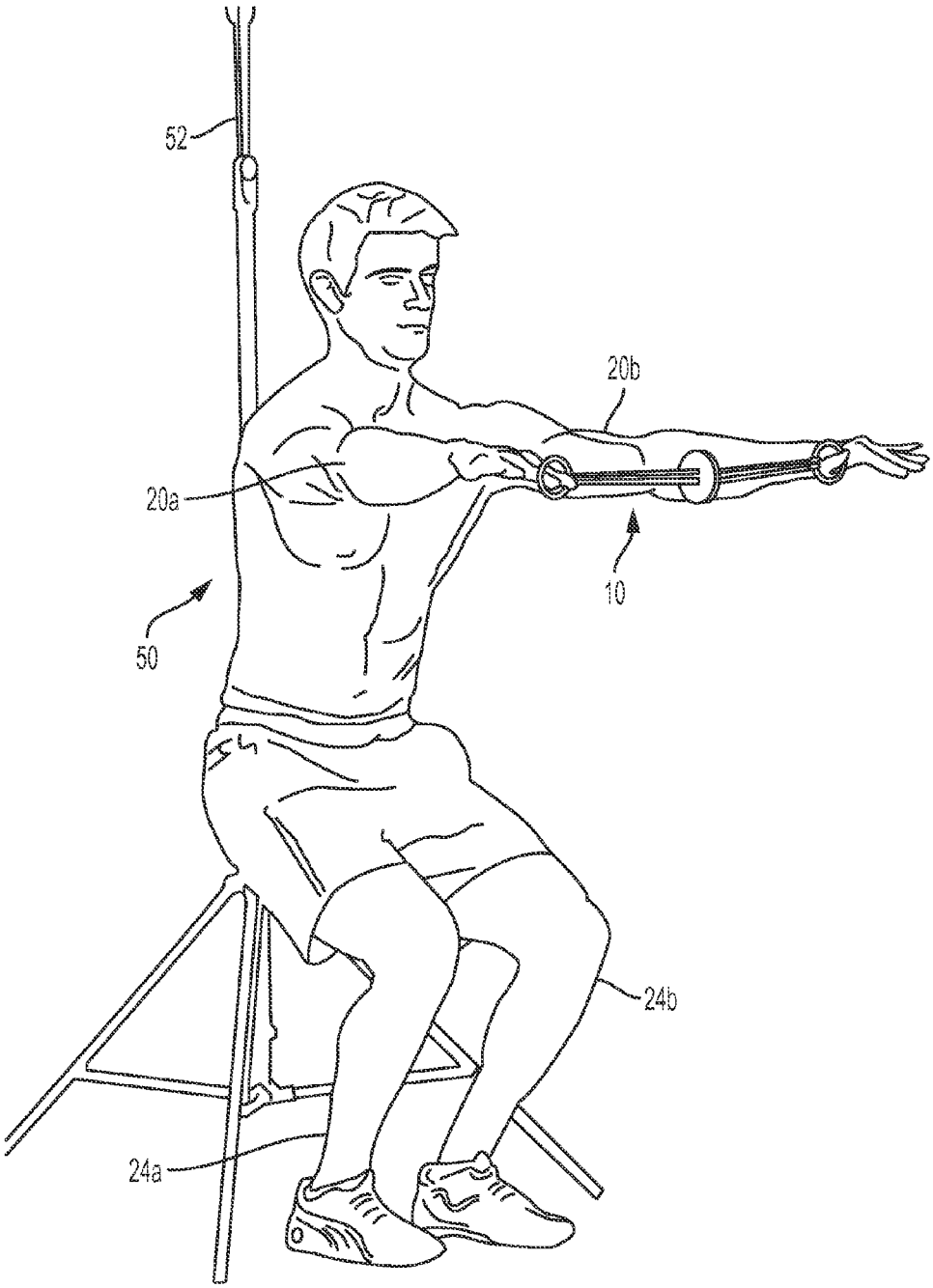
FIG. 9 is a front, side view of a user utilizing the exercise device of FIG. 1A in accordance with an embodiment of the invention, with the user's legs maintained in a partial squat position, and with his back maintained in position against an external structure.

In addition, as shown in FIG. 8, the user can be partially or fully seated and use the exercise device. In this example, the user's buttocks 48 are positioned on a floor or ground surface 49, with the legs bent forwardly of the user. As shown in FIG. 9, in one aspect the user's back 50 is held abutting an external structure 52. In the example shown, the external structure is simply a light pole—the structure need not necessarily support the user. In other embodiments, the external structure can provide sufficient support to allow the user to lean against and be supported by the external structure.

Figure 10:
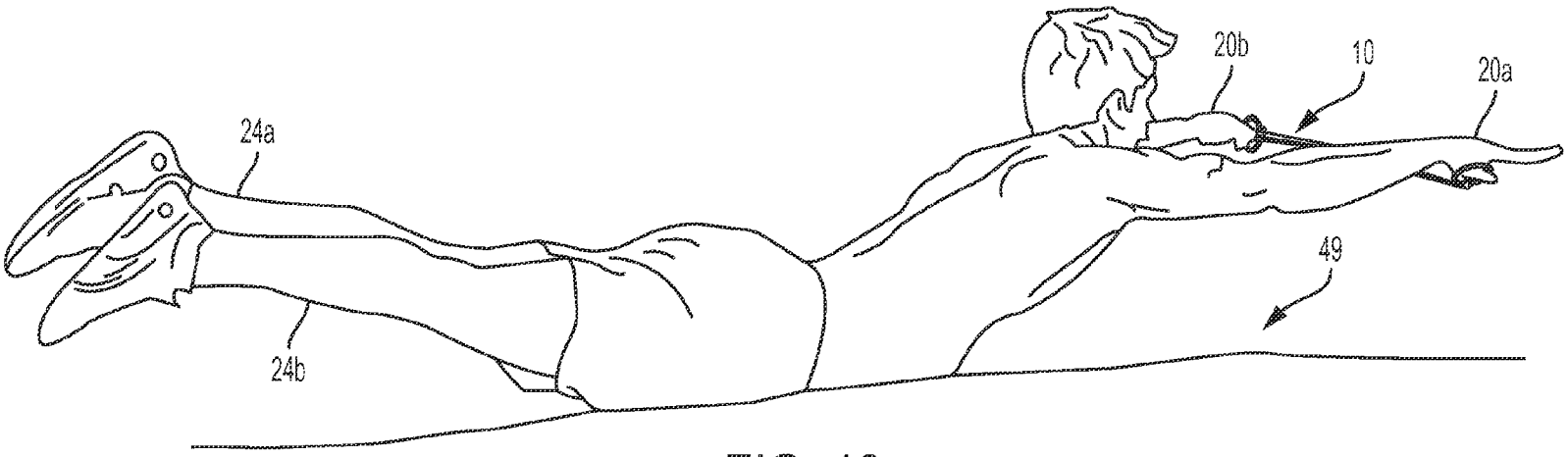
FIG. 10 is a front, side view of a user utilizing the exercise device of FIG. 1A in accordance with an embodiment of the invention, with the user's torso positioned in a prone attitude, and with his hands and feet suspended above the ground surface.

As shown in FIG. 10, in one example the user's body is maintained on the floor or ground surface 49 in a prone position. The user's arms 20*a*, 20*b* can be maintained in an elevated position, relative to the floor, as can the user's legs 24*a*, 24*b*. While not explicitly illustrated in the figures, in some aspects of the invention, a part of the user's body other than the arms or hands can be moved while applying the cyclic force to the tethers. For example, the user can move his or her head, torso, legs, etc., while maintaining the cyclic motion with the exercise device 10. In other embodiments, one or both of the user's hands can be moved during the exercise.

The examples provided above, and shown in the figures, are but some of the many exercise or PT routines encompassed by the present invention. The following examples provide succinct examples of some of these exercises, including many more, with some detail provided as the muscle groups exercised and the conditions that can be treated using the present invention. This listing is not be to construed as limiting:

Spinal Exercises:

Cervical:

Pathological Conditions: IVD Prolapse, Protrusion, Herniation 722.2 (ICD code), IVD Disorder W/O Myelopathy 722.0, IVD Disorder w/ Myelopathy 722.71, Spinal Stenosis 723.0, Cervicalgia 723.1, Cervicocranial Syndrome 723.2, Cervicobrachial Syndrome 723.3, Cervical Raduculitis 723.4, Muscle Spasm 728.85, Ligamentous Laxity 728.4, Myofascial Pain 729.1, Neuralgia/Neuritis 729.2, Cervical Segmental Dysfunction 739.1, Hyperflexion/Hyperextension Injury 847.0.

1. Scapular Retraction—Arms straight in front or bent activating rhomboids and mid trapezius. Squeeze and retract shoulder blades together.
2. Long Arm Shoulder Shrug—arms straight down at the user's waistline—shrug shoulders up and down recruiting upper trapezius, anterior/middle/posterior deltoid and all rotator cuff muscles—subscapulas, superspinatus, infrspinatus, teres minor.
3. Overhead Long Arm Scapular Retraction—Arms extended overhead, retractular scapular downward, rotating engaging latissimus dorsi, rhomboids and middle trapezius.
4. Head Rotation—arms bent, turn head slowly right, hold for a count of three, turning head left.

Thoracic:

Pathological Conditions: Thoracic Outlet Syndrome 353.0, Intercostal Neuralgia 353.8, Pain in the Thoracic Spine 724.1, Radiculitis 724.4, Muscle Spasm 728.85, Myofascial Pain 729.1, Neuralgia/Neuritis 729.2, Costochondritis 733.6, Segmental Dysfunction of the Thoracic Spine 739.2, Segmental Dysfunction Rib 739.8, Hyper/Hypo/Parasthesia 782.0, Sprain/Strain 847.1, Sprain/Strain Chondrosternal 848.42, Sprain/Strain Sternoclavicular 848.41, Sprain/Strain Sternum 848.40.

1. Scapular Retraction—Arms straight at shoulder level activating rhomboids, upper lattismus dorsi and mid trapezius. Squeeze and retract shoulder blades together.
2. Single Arm Row Retraction—In a bow and arrow position—one arm straight, the other bend and retracting—activating scapula, posterior deltoid and pectoralis major.
3. Diagonal "Scissors"—Diagonally holding arms and separating them apart, like a scissors, works on thoracic stabilization. Mid trapezius, rhomboid and intrinsic spinal stabilizers. Including multifidus, spinalus.
4. One Arm Punches—With one arm anchored to chest the other jab punches, activate serratus anterior, pectoralis major/minor, triceps.
5. Prone "Superman" With Alternate Arm Diagonals—Lying prone, lift upper body and disk cycle in front. Variations, one arm anchored to the floor. Activating middle trapezius, rhomboid, triceps, spinal intrinsic, ilio costalis, multifidus.
6. Thoracic Stretch—With arms overhead, extended wide, no bouncing and hold for a count of ten each side. Laterally flexing spine, repeat opposite direction.

Lumbar:

Pathological Conditions: IVD Disorder W/O Myelopathy 722.10, IVD Prolapse/Protrusion/Herniation 722.2, IVD Disorder w/Myelopathy 722.73, Low Back Pain 724.2, Sciatica 724.3, Backache 724.5, Facet Syndrome 724.8, Muscle Spasm 728.85, Myofascial Pain 729.1, Neuralgia/Neuritis 729.2, Segmental Dysfunction 739.3, Sprain/Strain 847.2.

Pelvis:

Pathological Conditions: Pain in the Pelvic Region or Thigh 719.45, Sacrolitis 720.2, Painful Tail Bone 724.79, Segmental Dysfunction Sacrum 739.4, Segmental Dysfunction Pelvis 739.5, Hyper/Hypo/Paresthesia 782.0, Fracture of Pelvis 808.8, Sprain/Strain Hip 843.9, Sprain/Strain Sacroiliac 846.1, Sprain/Strain Pelvis 848.5.

1. Abdominals—Rectus and Obliques—Seated on the floor or in a chair, back slightly arched, arms extended forward firing all the abdominal muscles including but limited rectus abdominus, transverse abdominus. Rotate torso forty-five degrees to additionally activate internal and external obliques.
2. Scapular Retraction with Abdominal Bracing (3 positions)—Standing tall, proper posture with arms extended forward and waist level, retracting scapular, repeat exercise at ninety degree arms to body and finally overhead.
3. Abdominal Bracing With Alternate Arm Punches—With one arm anchored to chest the other jab punches, activates serratus anterior, pectoralis major/minor, triceps.
4. Prone Superman with Overhead Shoulder Abduction—Lying prone, lift upper body with arms extended in front. Variations, one arm anchored to the floor. Activating middle trapezius, rhomboid, triceps, spinal intrinsic, ilio costalis, multifidus.
5. Wall Squats with Abdominal Bracing—Stand against a flat wall and squat as low as comfortable with 90 degrees hip flexion being the optimum. With arms extended in front or side punches—maintain as long as comfortable. Engages quadriceps, hamstrings, abdominals, erectus spinae, quadratus lumborum, spinal intrinsics.
6. Advanced "Wall Squat"/Chair Stance—With both legs bent in a low squat, maintain arms at 90 degrees, 120 degrees and full 180 degrees overhead (complete shoulder flexion).
7. Dynamic Lunges with Alternate Knee/Hip Flexion—Lunge by definition is one leg extended out front, knee not surpassing the foot. Lower down with back leg as far as comfortable. Maintain arms in the front arm, overhead or punch positions. Activating quadriceps, hamstrings, gluteus maximus/minimus core stabilizers, pectoralis major, rhomboids, trapezius and more.

8. Advanced Lumbar/Thoracic Stabilization—With a bent forward leg and one arm straight, upward row engaging latissum dorsi, pectoralis and all abdominal stabilizers.

Shoulder:

Pathological Conditions: Stiffness 719.52, Adhesive Capsulitis/Frozen Shoulder 726.0, Rotator Cuff Tear 726.1, Segmental Dysfunction Upper Extremity 739.7, Rotator Cuff Sprain 840.4, Sprain/Strain Shoulder 840.9, Sub-Acromial Impingement Syndrome 726.10.

1. Scapular Retraction (3 Way)—Standing tall, proper posture with arms extended forward and waist level, retracting scapular, repeat exercise at ninety degrees, arms to body and finally overhead. Upper middle and lower trapezius, rhomboids, lattismus dorsi.
2. Diagonal Scissors—Diagonally holding arms and separating them apart, like scissors, works on thoracic stabilization. Mid trapezius, rhomboid and intrinsic spinal stabilizers. Including multifidus, spinalus.
3. External Rotation: Single and Double at Neutral, 45 degrees and 90 degrees. Elbows pulled to start disk cycling externally recruiting supraspinatus, infraspinatus, teres minor, posterior deltoid. At forty-five degrees of glenohumeral joint abduction repeat exercise and finally at ninety degrees of glenohumeral abduction.
4. Low Abduction: Single and Double Arm—Long Arm Shoulder Shrug—with arms straight down at your waistline—shrug shoulders up and down recruiting upper trapezius, anterior/middle/posterior deltoid and all rotator cuff muscles—subscapulas, superspinatus, infrspinatus, teres minor.
5. Extension: One Arm Tricep KickBack—Stabilizing one arm in front of chest extend other arm straight and move from a flexed to an extended position at the shoulder joint only. Muscles engaged include Triceps, scapula stabilizers, all abdominal stablizers, rhomboids, latissum dorsi.
6. Flexion: One Arm Punches—With one arm anchored to chest, the other jab punches, activating serratus anterior, pectoralis major/minor and triceps.
7. Tricep Kickbacks—Stabilizing one arm in front of chest or attached to chest, extend other arm elbow high and move from a flexed to an extended position at the shoulder joint only. Muscles engaged include Triceps, scapula stabilizers, all abdominal stablizers, rhomboids, latissum dorsi.

Elbow:

Pathological Conditions: Carpel Tunnel Syndrome 354.0, Pain in Forearm 719.44, Pain in Hand 719.44, Stiffness in Forearm 719.53, Stiffness in Hand 719.54, Sprain/Strain Elbow/Forearm 841.0, Sprain/Strain Hand 842.1, Sprain/Strain Wrist 842.0.

1. One Arm Rows—In a bow and arrow position—one arm straight, the other bend and retracting—activating scapula, posterior deltoid and pectoralis major.
2. One Arm Punches—With one arm anchored to chest the other jab punches, activate serratus anterior, pectoralis major/minor, triceps.
3. Biceps Curls: Brachialis and Brachioradialis (Supinated and Pronated)—With one arm extended straight, place 2 fingers in the ring and curl other arm up towards your chin. At a forty-five degree angle to the body and sixty degree angle to the body. Rehabs Brachialis and Brachioradialis.
4. Tricep Kickbacks—Stabilizing one arm in front of chest or attached to chest, extend other arm elbow high and move from a flexed to an extended position at the shoulder joint only. Muscles engaged include triceps, scapula stabilizers, all abdominal stablizers, rhomboids, latissum dorsi
5. Wrist Pronation/Supination/Extension/Flexion/Ulnar deviation/Radial deviation—Holding device in a clenched first activating solely at the wrist joint, disk cycle in a variety of directions.

Wrist:

Pathological Conditions: Carpel Tunnel Syndrome 354.0, Pain in Forearm 719.44, Pain in Hand 719.44, Stiffness in Forearm 719.53, Stiffness in Hand 719.54, Sprain/Strain Elbow/Forearm 841.0, Sprain/Strain Hand 842.1, Sprain/Strain Wrist 842.0.

1. Wrist Pronation/Supination/Extension/Flexion/Ulnar deviation/Radial deviation—Holding the device in a clenched first activating solely at the wrist joint, disk cycle in a variety of directions.
2. One Arm Punches—With one arm anchored to chest the other hand/arm jab punches, activating serratus anterior, pectoralis major/minor, triceps.
3. One Arm Rows—In a bow and arrow position—one arm straight, the other bend and retracting—activating scapula, posterior deltoid and pectoralis major.
4. Stretches—Wrist Flexion/Extension Done passively with the device.

Knee/Ankle/Foot:

Pathological Conditions: Meniscus Tear/Chronic 718.0, Pain in Lower Leg 719.46, Segmental Dysfunction Lower Extremity 739.6, Meniscus Medial Tear 836.0, Meniscus Lateral Tear 836.1, Sprain/Strain Knee 844, Sprain/Strain Lateral Collateral Ligament 844.0, Sprain/Strain Medial Collateral Ligament 844.1, Sprain/Strain Cruciate Ligament 844.2, Sprain/Strain Ankle-Unspecified 845.00, Sprain/Strain Foot 845.1.

1. Bent Knee Hip Abduction—Seated either on the floor or in a chair with ulna pressed against lateral aspect of knee important not to engage arms and use legs ONLY. Rotate legs in and out—for a more advance glute engagement, lift one leg.
2. Wall Squats with Upper Extremity Rows—Stand against a flat wall and squat as low as comfortable with ninety degrees hip flexion being the optimum. Disk cycle with arms extended in front or side punches—maintain as long as comfortable. Engage quadriceps, hamstrings, abdominals, erectus spinae, quadratus lumborum, spinal intrinsics.
3. Dynamic Wall Squats With Rows—Lunge by definition is one leg extended out front, knee not surpassing the foot. Lower down with back leg as far as comfortable. Use the device in the front arm, overhead or punch positions. Activating quadriceps, hamstrings, gluteus maximus/minimus core stablizers, pectoralis major, rhomboids, trapezius and more.
4. Lunges with Rows—Lunge by definition is one leg extended out front, knee not surpassing the foot. Lower down with back leg as far as comfortable. Use the device in the front arm, overhead or punch positions. Activating quadriceps, hamstrings, gluteus maximus/minimus core stablizers, pectoralis major, rhomboids, trapezius and more.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

I claim:

1. A method of fatiguing one or more target muscle groups of a user using an exercise device, comprising:

grasping in each hand one of a pair of outer handles of an exercise device, each of the pair of outer handles being connected to at least one tether, the at least one tether being one or both of a pair of tethers extending through a pair of orifices formed in a central disk suspended between the outer handles;

positioning the user's feet to be substantially aligned with the user's shoulders while maintaining the user's torso in a substantially upright orientation;

positioning each hand in an initial position relative to the user's torso;

rotating one or both of the user's hands grasping the outer handles to cause the central disk to rotate to thereby cause the pair of tethers to twist about one another;

cyclically pulling the outer handles away from one another in a cyclic motion to apply a cyclic pulling force to the tethers to cause the central disk to alternately rotate in opposing directions of rotation, the cyclic motion thereby applying a cyclic force to an initial target muscle group of the user to thereby fatigue the target muscle group; and moving one or both hands to a secondary position relative to the user's torso and repeating the application of the cyclic force to fatigue the initial target muscle group or to fatigue a secondary target muscle group.

2. The method of claim 1, wherein positioning each hand in an initial position relative to the user's torso comprises positioning each hand at substantially the same height.

3. The method of claim 1, wherein positioning each hand in an initial position relative to the user's torso comprises positioning each hand at substantially a height of the user's naval.

4. The method of claim 1, wherein positioning each hand in an initial position relative to the user's torso comprises positioning each hand at substantially a height of the user's sternum.

5. The method of claim 1, wherein positioning each hand in an initial position relative to the user's torso comprises positioning each hand at substantially a height of the user's chin.

6. The method of claim 1, wherein positioning each hand in an initial position relative to the user's torso comprises positioning each hand over the user's head.

7. The method of claim 1, wherein positioning each hand in an initial position relative to the user's torso comprises positioning each hand with at least one of the user's arms bent at the elbow.

8. The method of claim 1, wherein positioning each hand in an initial position relative to the user's torso comprises positioning each hand with at least one of the user's arms substantially unbent at the elbow.

9. The method of claim 1, wherein positioning each hand in an initial position relative to the user's torso comprises positioning each hand at differing elevations.

10. The method of claim 1, wherein cyclically pulling the outer handles away from one another in a cyclic motion to apply a cyclic pulling force to the tethers comprising maintaining the position of a first hand while moving a second hand away from the first hand.

11. The method of claim 1, further comprising moving a part of the user's body other than the arms or hands while applying the cyclic force to the tethers.

12. The method of claim 11, wherein the part of the user's body being moved includes at least one of the user's head, the user's torso or the user's legs.

13. A method of fatiguing one or more target muscle groups of a user using an exercise device, comprising:

grasping in each hand one of a pair of outer handles of an exercise device, each of the pair of outer handles being connected to at least one tether, the at least one tether being one or both of a pair of tethers extending through a pair of orifices formed in a central disk suspended between the outer handles;

bending one or more of the user's legs while maintaining the user's spine in a substantially straight orientation;

positioning each hand in an initial position relative to the user's torso;

rotating one or both of the user's hands grasping the outer handles to cause the central disk to rotate to thereby cause the pair of tethers to twist about one another; and cyclically pulling the outer handles away from one another in a cyclic motion to apply a cyclic pulling force to the tethers to cause the central disk to alternately rotate in opposing directions of rotation, the cyclic motion thereby applying a cyclic force to an initial target muscle group of the user to thereby fatigue the target muscle group.

14. The method of claim 13, wherein the user's buttocks are supported on a ground or floor surface.

15. The method of claim 13, wherein the user's back is held abutting an external structure.

16. The method of claim 13, wherein both of the user's legs are bent beneath the user's torso.

17. The method of claim 13, wherein one of the user's legs is bent and extended forwardly of the torso, and another of the user's legs extends rearwardly of the torso.

18. A method of fatiguing one or more target muscle groups of a user using an exercise device, comprising:

grasping in each hand one of a pair of outer handles of an exercise device, each of the pair of outer handles being connected to at least one tether, the at least one tether being one or both of a pair of tethers extending through a pair of orifices formed in a central disk suspended between the outer handles;

positioning the user's torso in a prone position on a floor or ground surface;

positioning each hand in an initial position relative to the user's torso;

rotating one or both of the user's hands grasping the outer handles to cause the central disk to rotate to thereby cause the pair of tethers to twist about one another; and cyclically pulling the outer handles away from one another in a cyclic motion to apply a cyclic pulling force to the tethers to cause the central disk to alternately rotate in opposing directions of rotation, the cyclic motion thereby applying a cyclic force to an initial target muscle group of the user to thereby fatigue the target muscle group.

19. The method of claim 18, further comprising suspending the user's feet above the floor or ground surface.

20. The method of claim 19, further comprising suspending the user's hands above the floor or ground surface.

* * * * *